8-107 SR
FIP8309 XR 4,118,183

United States Patent [19] [11] 4,118,183
Godau et al. [45] Oct. 3, 1978

[54] PROCESS FOR THE TREATMENT OF WARP YARNS

[75] Inventors: Eckhardt Godau, Hofheim, Fed. Rep. of Germany; Max Schneider, Glarus, Switzerland

[73] Assignee: Quikoton AG, Glarus, Switzerland

[21] Appl. No.: 783,482

[22] Filed: Mar. 31, 1977

[30] Foreign Application Priority Data

Apr. 9, 1976 [CH] Switzerland ..... 4494/76

[51] Int. Cl.[2] ..... D06P 5/00; D06P 7/00; D06B 1/00

[52] U.S. Cl. ..... 8/18 R; 8/21 C; 8/35; 8/38; 8/54.2; 8/107; 8/147; 8/151.2; 28/179

[58] Field of Search ..... 8/18 R, 38, 151.2, 54.2; 28/72.6, 28, 179

[56] References Cited

U.S. PATENT DOCUMENTS

| | | | |
|---|---|---|---|
| 1,500,894 | 7/1924 | Robertson et al. | 8/151.2 |
| 2,108,188 | 2/1938 | Batchelder | 8/151.2 |
| 2,675,601 | 4/1954 | Still | 28/72.6 |
| 2,696,653 | 12/1954 | Park | 28/72.6 |

FOREIGN PATENT DOCUMENTS 933,664 8/1963 United Kingdom.

*Primary Examiner*—A. Lionel Clingman
*Attorney, Agent, or Firm*—Werner W. Kleeman

[57] ABSTRACT

A process for the treatment of warp yarns as a row of substantially parallel threads, wherein said yarns are impregnated with excess treating liquor, said excess is removed from the yarns and the treated yarns are finally dried and wound up on a loom beam, the improvement of bringing the linear thread density of the yarns, at least in the excess liquor removal zone, to a value of 2 or higher, said value being the same over the entire width of said yarn row, and reducing said yarn density to the nominal thread count for weaving before said yarns are wound up on at least one loom beam.

10 Claims, 4 Drawing Figures

PROCESS FOR THE TREATMENT OF WARP YARNS

FIELD OF THE INVENTION

This invention belongs to the field of the treatment of warp yarn in a continuous manner, before this warp yarn is woven, together with a weft yarn, into a fabric. The invention concerns especially a new, continuous process for the dyeing of cotton warp yarn with an indigo vat, or for the sizing of such warp yarn, or for first dyeing and then sizing of such yarn.

The cotton warp yarns treated by the process of the invention can be used in great quantities for the manufacture of woven fabrics known as "blue denim", and from these fabrics, apparel is made, particularly the well-known leisure apparel. Other treatments effected by the process of the invention impart particularly equal finishing properties to the thus treated warp yarns.

BACKGROUND AND SUMMARY OF THE INVENTION

It has already been known to dye cotton warp yarn in a continuous process named chain dyeing; see, e.g., Fischer-Bobsien, Internationales Lexikon Textilveredlung, 4th ed., 1975, p. 286; and P. Richter in "Textilveredlung" 10, 1975, p. 313–7. In this process, yarn cables called ball warps, consisting each of about 350 to 400 single warp yarns, are introduced in parallel relationship into a dipping vat containing the reduced leuco form of indigo. Then the excess of vat is squeezed from the yarn cables or bundles, and the vat dye thereon is allowed to oxidize in air to give the blue indigo. The yarn cables or ball warps are then repeatedly immersed in the vat, squeezed and exposed to air until the desired color depth is obtained. Finally, the ball warps are rinsed one or two times, the rinsing liquor is squeezed out, and the ball warps are dried on a drying cylinder after an optional livening treatment. The ball warps coming from the drying cylinder must now be opened or rebeamed, and they are then wound up on several loom beams.

This method has serious drawbacks since it is necessary to install a special dyeing machine equipped with special units for the forming of the ball warps and the rebeaming of the dyed yarn cables. In particular, the rebeaming step is rather difficult and ticklish and requires very skilled workmen. A further drawback is the fact that the obtained dyeing is always unlevel since there are irregularities when the yarn cables are immersed into the vat, during squeezing off the vat excess, and during air oxidation. Other inequalities result from the fact that adjacent ball warps are often not in touch with each other.

These unlevel results may partially and statistically be compensated by mixing the yarns during the rebeaming step and during the winding up on the loom beams. On the fabric made from such a dyed warp yarn, clearer and darker spots are alternating so that the aspect of the fabric is the characteristic one of the known "real indigo" fabrics.

Efforts have already been made to improve the dyeing level in continuous dyeing methods of cotton warp yarn with indigo vat, and to avoid the complexity of the chain dyeing machine. It has been tried to adapt the existing sizing or slashing machines to the vat indigo dyeing process.

In the well-known sizing or slashing machines, the yarn, being unwound from front warp beams, is continuously immersed as a row of parallel yarns, in the width of the future fabric, into a trough containing a sizing bath. The yarns are impregnated with the sizing liquor, and the excess thereof carried away by the yarn is removed therefrom between squeeze rollers. The squeezed yarns are dried, normally on drying cylinders, and finally wound into a final warp beam or loom beam.

Attempts have already been made to effect continuous vat dyeing of warp yarns on a modified slasher; see the already cited publication in "Textilveredlung" and M. Peter, Grundlagen der Textilveredlung, Stuttgart 1970, p. 178. This method is sometimes called "slasher dyeing" since it is basically performed like the sizing or slashing mentioned above. The method comprises passing the warp yarns, not in the form of bundles or cables made from a plurality of warp yarns, but in the form of a substantially parallel thread row, through the indigo vat, squeezing an excess of vat from the yarns, and exposing the squeezed yarns to air for oxidation of the leuco indigo, repeating the steps of vat immersion, squeezing and oxidizing until the desired color density is reached (at least three times, generally four to six times), washing the yarn, optionally aviving it, and winding the yarn on a loom beam.

In this method too, it is always found that the resulting dyeing is not level. This unlevelness consists in the fact that some yarns are darker and some are lighter dyed than the bulk. Whereas the overall unlevelness of the chain dyeing method may be equalized in mixing the yarns from the ball warps, the unlevelness of the slasher dyeing cannot be compensated in this way, since after weaving the dyed warp yarns, the fabric shows darker and lighter strips. It has not been possible until now to eliminate these dyeing defects.

In the method of slasher dyeing, the linear thread density in the squeezing zone is not higher than 1.25 and generally lies in the range from 0.9 to 1.2. The linear thread density Q is defined as the product of the thread count F (in $cm^{-1}$) and the yarn diameter D (in cm):

$$Q = F \times D.$$

Of course, F and D may be expressed in other length units, like inch, as far as they are the same for F and D. The thread count is a current expression in the field of weaving; it defines the number of substantially parallel threads or yarns over a given width of fabric or similar thread arrangements. In the conventional techniques of slasher dyeing, the thread count in the nip between the squeezing rollers substantially equals the thread count on the loom beam.

It has been supposed that the accumulation of yarns in certain regions of said squeeze nip, i.e. the overlapping of two or more yarns in these regions, would be responsible for the unlevel dyeing. In these regions, the squeezing force is particularly high, and the amount of vat remaining on the yarns in said regions is particularly low. However, experiments wherein the thread count in said squeeze nip and, consequently, the linear thread density, were reduced, have not proved successful.

The working techniques of a slasher dyeing machine fully correspond to those of a warp sizing machine. The warp yarns sized in the latter present exactly the same unlevelness of sizing as that described above for the indigo dyeing on such a machine, modified for vat dyeing, with the exception that unlevel sizing is not visible.

It has not been possible until now to explain the fact that there arise sometimes problems during weaving, and these problems were attributed to a possibly too high squeezing ratio in the sizing equipment. Consequently, for sake of safety during weaving, the warp yarns have always been oversized which is a waste of material, time and energy.

With the foregoing in mind it is here to be noted that the present invention has for one of its primary objectives to improve the techniques in the slasher dyeing of cotton warp yarn with indigo vat dye, and to improve the technique of warp yarn sizing.

A further and more general objective is to provide a new process wherein the principle of the known slasher dyeing and sizing machines is applied to all possible finishing operations normally carried out on warp yarns of any kind, in such a manner that, in one aspect, finishing operations become possible which could not yet be performed on such machines, and, in another aspect, such treatments impart perfectly level finishing effects on warp yarns.

A further and more specific objective is to provide an improved method selected from the group consisting of dyeing of warp yarns which enjoy the notable advantage of giving very level effects, namely a level dyeing and a level sizing.

There is another objective of the instant invention to permit, at the same time, a substantially improved production output.

Now in order to implement these and still further objects of the invention, which will become more readily apparent as the description proceeds, the invention is directed to continuously treating warp yarns by a method, wherein a row of substantially parallel, unbundled warp yarns is impregnated with an excess of a treating liquor, said excess is then removed from the impregnated yarns in a liquor removing zone, the yarns are dried and finally wound up on a loom beam, and contemplates that, at least in said liquor removal zone, the linear thread density of the warp yarn row, expressed by the relation $Q = F \times D$, wherein Q is the linear thread density, F is the thread count in $cm^{-1}$, and D is the mean diameter of each thread in cm, is brought to a value of at least 2, said value of at least 2 being constant over the entire width of said yarn row and being the same at any width increment, and the finally dried warp yarns are wound up on at least one loom beam, said increased linear thread density of at least 2 being reduced to the nominal thread count for weaving of each loom beam before the treated warp yarns are wound up on said beam.

BRIEF DESCRIPTION OF THE DRAWING

Therefore, the invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
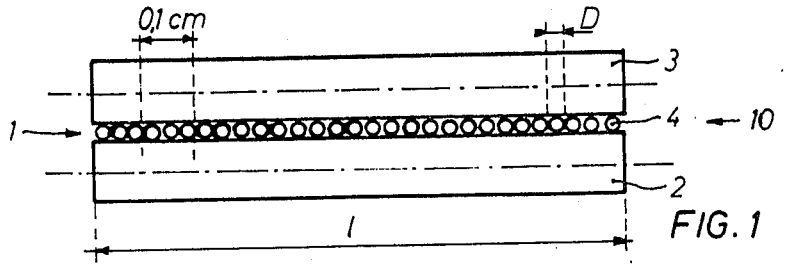
FIG. 1 schematically shows the condition of the warp yarns between squeezing rollers, according to prior art techniques, Q being about 1.

Before dealing with the description of the drawing, specific features of the invention will be discussed.

Generally speaking, the process of the invention applies to any finishing treatment normally realized on warp yarns. Non-limiting examples for such treatments are bleaching, rinsing, dyeing, optical brightening, treatment with swelling agents like NaOH or $NH_3$ for cotton or $ZnCl_2$ solutions for nylon, livening, sizing, softening, hydrophobing and so on. The practical performance of these treatments and the compositions of the treatment baths or liquors are known to the man skilled in the art; it is therefore not deemed necessary to discuss these features in detail. For example, reference is made to the corresponding keywords in Fischer-Bobsien, Internationales Lexikon Textilveredlung und Grenzgebiete, A. Laumann ed., Dulmen (West Germany) 1975.

The nature of the warp yarns to be treated is not critical. Examples of such yarns are those from wool, cotton, rayon and synthetic fibers like polyester, polyamide, polyacrylics, polyolefines, polyurethanes, cellulosic esters etc. as well as the numerous known fiber blends. These examples are not construed to limit the invention.

In the process of the invention, the feature that the increased value of the linear yarn density is constant over the entire width of the liquor removing zone and is the same at any width increment, is essential. This means that not only at least two warp yarns are in superposed condition but also that adjacent yarns are in touch without forming gaps. It is believed — but without intention to be fixed upon this idea — that said feature is an important condition of the outstanding levelness of the finishing results according to the invention.

The man skilled in the art will appreciate that the good level finish obtained by the invention is highly surprising since, at Q values of up to about 1.25 and higher than about 350 in the processes of the prior art of chain and slasher dyeing, severe unlevel effects are obtained. It could therefore not be expected that at Q values higher than about 2 (and up to about 20 with the present knowledge), high level effects are reached.

In the process of the invention, the condition $Q \geqq 2$ means that at least 100% of the warp yarns are in superposed relationship, namely at least during the step of the removal of excess treating liquor. It is generally preferred to remove said excess in squeeze roller units kown per se.

It is necessary that the condition of double or multiple yarn layers between the squeeze rollers is uniform over the entire width of these rollers. This means that the predeterminated Q value of 2 or higher can be measured at any width increment between the squeeze rollers. In practice, such values of Q are selected which present integers, like 2, 3, 4 and so on, or, alternatively, such Q values are preferred which are integral multiples of that Q value which has been used before on the contemplated machine. Thus, if a certain sizing machine or a slasher dyeing machine has been built and provided for a linear thread density Q of, say, 1.25, it is preferred to run such a machine, according to the invention, with a Q value selected from $Q_1 = 2.50$, $Q_2 = 3.75$ etc. Due to practical considerations, the maximum $Q_n$ value is presently about 20. This value is considerably lower than corresponding values of about 350 to 400 in chain dyeing processes which require costly special machines.

Dyeing experiments carried out with a Q value of about 2.5 have very surprisingly resulted in not only a substantial improvement of the dyeing level but also in an improvement of the wet abrasion fastness of the dyed yarn, by at least one note of the official Swiss standard scale.

The process of the invention affords, compared with the known processes of chain dyeing and slasher dyeing, a substantially higher production rate. The level of the obtained finish like dyeing and sizing is improved over that known for "real indigo".

Surprisingly, it has further been found that the yield of finishing composition is improved by about 20 to 30% compared with the actual yields of the conventional methods.

The general performing of the process of the invention is based on the conventional techniques normally used, which are known to one skilled in the art and, therefore, need not be described in detail. Reference is made to the technical literature, e.g. the already cited article by P. Richter in "Textilveredlung", to Ullmanns Encyklopadie der technischen Chemie, 3rd ed., 1966, vol. 17, p. 250 ff where further literature is cited, and to the Encyclopedia of Science and Technology, McGraw-Hill, 1960, vol. 13, p. 534 ff.

It has already been said that integral values of the linear thread density, i.e. whole numbers of 2 and higher, are preferred in the process of the invention. There is a practical reason for this fact since the width of the final loom beam and, thus, the working width of the treating machine — which has until now been run with a Q value of about 1 — are predeterminated dimensions. In the process of the invention, it is now contemplated to use an additional number of Q-1 final loom beams dependent from the actually used Q value; if Q = 2, the treating machine works on two loom beams which may be mounted, for example, in vertical relationship.

If other Q values are selected which are not whole numbers, the working width of the used machine will be a fraction of that of the final loom beam, that fraction being 1/Q or, in percentages, 100 × 1/Q%. The two measures may be combined: if Q is greater than 2 but not a whole number, then the number of loom beams is greater than one and the machine is narrower than each loom beam.

Whereas it is preferred to use squeeze rollers in order to remove the excess of treating liquor from the impregnated yarns, said excess may also be removed by any other means, e.g. by suction into porous substrates, or pneumatically by pressurized air or by air suction.

In a variant of the process of the invention, the value of Q ≧ 2 may be provided in the following manner. Auxiliary threads or yarns which are not led into the vat or the sizing trough, are introduced, together with the impregnated warp yarn, into the nip of the squeeze rollers. These auxiliary yarns may then be wound up on a beam behind the last squeezing unit or may be returned to the first squeezing unit. The number and density of the auxiliary yarns can be selected to give any desired value of Q, together with the impregnated warp yarns, in the contemplated range of from 2 to 10.

Another variant is the use of an auxiliary fabric instead of auxiliary yarns. All the described variants, features and embodiments may also be combined. Thus, for example, the linear thread density of the warp yarns may first be increased from 1 to 1.5. Then, auxiliary yarns are used in such a number that Q is increased from 1.5 to about 2.5. Finally, an auxiliary fabric is also introduced, and Q rises from about 2.5 to about 3.5.

The process of the invention is illustrated in the drawing by dyeing and sizing. All other possible finishing operations, see above, may be conducted in a fully analogous manner.

Turning now to the drawing, a roller squeezing unit 10 is schematically shown in FIG. 1 as a front view. In the nip 1 between the lower roller 2 and the upper roller 3 (the rollers 2 and 3 are forced together by the application of an appropriate pressure), there are the warp yarns, the individual threads 4 thereof are in parallel relationship and fill the nip without free spaces nor overlapping. The diameter of each yarn 4 is designed by D, and the total width of rollers 2 and 3 by 1. Using the thread count F along a width of 1 cm in the nip, the value $Q = F \times D$ can be calculated. For example, if $F = 30\ cm^{-1}$ (3 threads on 0.1 cm) and $D = 0.033$ cm, Q is $30\ cm^{-1} \times 0.033\ cm = 1$. This condition of classic techniques is shown in FIG. 1.

Figure 2:
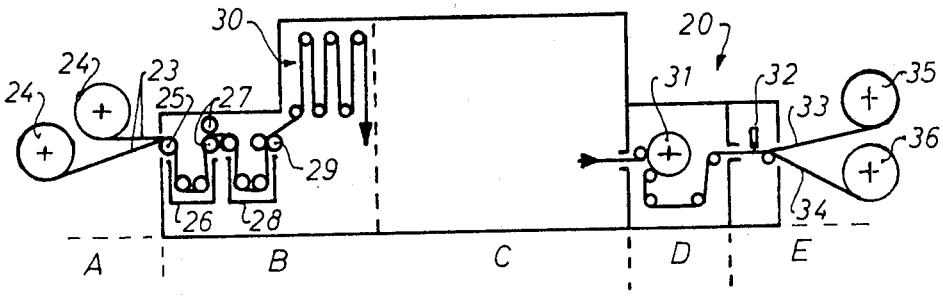
FIG. 2 shows a schematical side view of an equipment which may be used to carry out the process of the invention.

FIG. 2 shows a schematical side view of a sizing machine 20 which has been modified for indigo vat dyeing. Section A is the yarn supply wound on warp beams, section B an indigo vat dyeing unit, section C three to six further dyeing units, section D the dryer unit, and section E the winding up units on loop beams.

In section A, there are shown two warp beams 24 having about 1.25 times the working width of the dyeing machine. On each warp beam 24, the warp yarns are bobbined in substantial parallel and contacting relationship. After the combining of the warp yarns 23 to a row of substantially parallel warp yarns in the dyeing machine 20, a linear thread density of about 2 × 1.25 = 2.5 is obtained. The combination of the two warp yarn series 23 is accomplished on the roller 25 of the dyeing section B.

The combined yarns first enter the trough 26 containing an aqueous surfactant solution and they are therein rendered receptive for the indigo vat immersion. The excess of surfactant solution is then squeezed from the yarns between the pair of rollers 27. The parallel warp yarns are then introduced into the immersion vat 28 wherein they are impregnated with the leuco indigo solution. The excess therof is squeezed from the yarns between the pair of squeeze rollers 29. Thereafter, the yarns effect an air passage in the guide roller compartment 30. During this air passage, the leuco indigo is oxidized to the blue indigo pigments. The warp yarns may be washed between the steps of wetting in trough 26 and the immersion in the vat 28.

The step of impregnation by immersion in the indigo vat and subsequent air passage is repeated 3 to 6 times in section C. The individual dyeing and oxidation units are not represented since they are identical with the unit 28, 29, 30.

The yarns are now subjected to a washing step (not represented) and pass then into the dryer section D where they are dried on the heated cylinder 31. Instead of the heating cylinder 31, a contact free hot air drying (hot-flue) may be provided. After leaving the dryer section D, the yarns are separated on the comb 32 into two distinct yarn rows 33 and 34, each of which contains half of the yarns treated within the machine, and each of both separated rows 33 and 34 is wound up on loom beams 35 and 36 having each 1.25 times the width of machine 20 and corresponding each to the weaving width of a downstream weaving loom, the yarns being wound up in parallel and contacting relationship.

Figure 3:
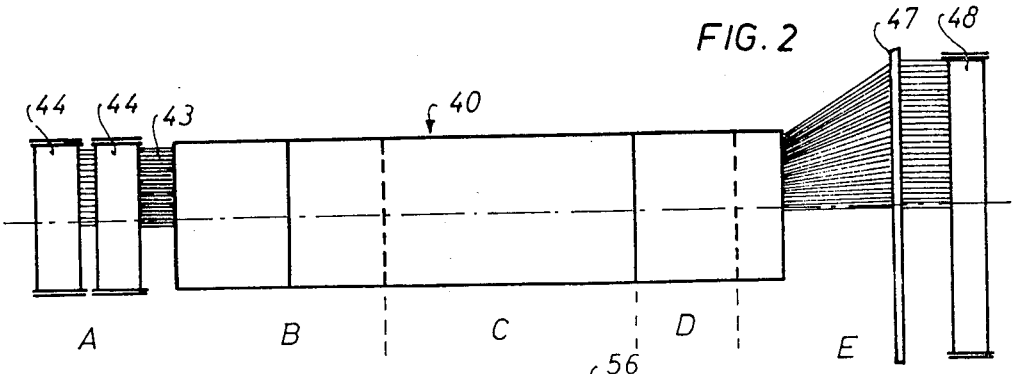
FIG. 3 schematically represents a top view of a similar equipment to that of FIG. 2.

FIG. 3 shows the top view of a machine 40 identical to the machine 20 in FIG. 2 with the exception of section E. The individual sections A to D correspond to those in FIG. 2. The warp yarns are wound off from two warp beams 44, and the combined warp yarns are designed by numeral 43. The dyed and dried warp yarns, after having passed sections A to D, are wound up in parallel and contacting relationship on a loom beam 48 having twice the width than each warp beam 44. The yarns leaving machine 40 are spread by an appropriate device 47, e.g. a comb or a scrim rail, and made parallel to each other.

Figure 4:
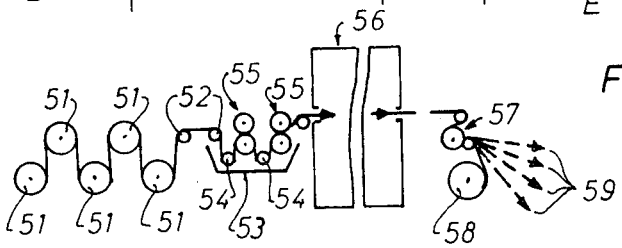
FIG. 4 is a schematical side view of a slasher or sizing machine.

In FIG. 4 there is shown a sizing machine 50 in schematical side view. The machine comprises five warp beams 51 each of which has the same width as the working width of the machine 50. The warp yarns are combined in the represented manner to a row of parallel yarns, the linear thread density Q thereof being 5. The yarns are conducted by the guide roller 52 into the trough 53. Within the trough which contains an aquous sizing bath are disposed immersion rollers 54. The amount of sizing bath taken up by the yarns is controlled by the immersion depth of the rollers 54 and the pressure between the squeeze rollers 55. The yarns are dried in the dryer 56 (a hot-flue or a cylinder) and then equalized and separated in the device 57. The separated yarn rows having a linear thread density of about 1 per row are wound up on five loom beams 58 of which only one is represented. Numerals 59 indicate the yarn which is directed to further loom beams.

The process of the invention can, for example, be used for indigo vat dyeing only, for sizing only, or for indigo vat dyeing and subsequently sizing of cotton warp yarns. In the last mentioned case, it is preferred not to wind up the dyed yarns coming from the dyeing machine but to conduct them directly as they leave section C in FIG. 2, into the sizing machine of FIG. 4 which in this case does not comprise the warp beams 51. The same applies to embodiments wherein the yarns are first bleached, then dyed and finally sized, and to other sequences of this kind.

The process of the invention will be further illustrated by the following Examples.

EXAMPLE 1

This example shows the general dyeing techniques in a modified slasher machine, according to known methods.

A cotton warp yarn, yarn count NE 9, mean diameter of each yarn = 0.031 cm, is dyed in the following indigo vat:

10 gms/liter indigo dyestuff 98% pure,
20 gms/liter aqueous NaOH 50° Be,
25 gms/liter sodium hydrosulfite (sodiumdithionite),
15 ml/liter isopropanol and
2 ml/liter non-ionic surfactant.

The yarn is wound off from 6 warp beams of 690 threads each and is drawn as a parallel yarn row, width 160 cm, through the first dyeing bath. The excess of dyeing vat is then removed by squeeze rollers having a working width of 130 cm, and the leuco dyestuff is oxidized in an air passage of the yarns during 60 seconds. These operations of immersion, squeezing and oxidation are repeated three times. The yarns are then thoroughly rinsed, dryed on a drying cylinder, and wound on a loom beam having a width of 200 cm. The linear thread density during the described process is about 1.25.

The yarns are now used, directly from said loom beam, as warp yarns for making a denim fabric, using undyed weft yarn. The obtained fabric shows clear and dark stripes or streaks in warp direction, compared with a conventional blue denim fabric.

EXAMPLE 2

The working techniques of Example 1 are repeated, but with the exception that twelve warp beams are used from which the warp yarns are wound off, and that the dyed and dried yarns are wound on two loom beams disposed in successive horizontal relationship. The linear thread density was therefore double that in Example 1, i.e. about 2.50.

In this Example, the production rate has been rendered twofold. Furthermore, a significantly deeper color was observed so that the dyestuff concentration in the indigo vat could be reduced. The wet abrasion fastness, tested according to the standards of Swiss Standards Association (SNV), was by 1 note higher than that of the dyed yarn in Example 1. The fabrics woven from the yarns were perfectly level in color.

EXAMPLE 3

The same cotton warp yarn as in Examples 1 and 2 is sized in an installation similar to that of FIG. 4. The warp yarn is wound off from 12 of the described warp beams, the working width of the sizing machine being about 80 cm. The linear thread density of the row of the combined, parallel warp yarn is therefore about 5.

This yarn row is now introduced into a sizing bath which has been prepared as follows. An aqueous mixture containing, per liter, 70 g of potato starch and 1 g of beef tallow is cooked in a pressure cooker for 5 minutes at about 110° C. The mixture is allowed to cool to about 80° C. and then pumped into the sizing trough where this temperature of 80° C. is maintained.

The yarns are twice dipped and squeezed as shown in FIG. 4. They are then dried, separated into 5 equal yarn rows and wound up on 5 loom beams.

Although about 30% less sizing preparation is applied to the yarns, compared with conventional sizing, there are no problems encountered during subsequent weaving. When a fluorescent dyestuff was added to the sizing bath and the yarns are afterwards inspected under an U.V. lamp, the perfectly uniform layer of sizing composition thereon could be shown.

EXAMPLE 4

The cotton warp yarn defined in Example 1 is mercerized in an installation similar to that of FIG. 4. The yarn is wound off from 5 warp beams and combined into a homogeneous row of parallel yarns having a linear thread density of about 5. This row is now introduced into the treating trough filled with an aqueous 24% by weight solution of sodium hydroxide at 20° C. containing per liter 5 g of "Mercerol QW", a cresol free, anion active mercerizing auxiliary of Sandoz, Basle, Switzerland. The row is guided within the trough and beneath the liquor level by an appropriate number of guide rollers during 60 seconds, the thread tension of the yarns being kept constant. Then, excess caustic is squeezed off between squeezing rollers, and the yarns are made free from caustic in another trough containing a diluted acid solution, also under constant tension. The yarns are then rinsed, dried and wound up, after separation, on 2 loom beams.

The obtained mercerizing effect distinguishes by its particularly good uniformity. Problems heretofore encountered due to yarn breaks and yarn loops could no longer be observed.

EXAMPLE 5

The mercerizing of Example 4 is repeated with the exception that liquid ammonia of about −40° C. is used as the mercerizing liquor. Free ammonia is removed from the yarns, after the squeezing off of the liquid ammonia, by treatment with hot water.

In this Example too, a fully uniformly mercerized cotton warp yarn is obtained. The production rate could be increased to about three times, compared with the conventional methods. At the same time, ammonia consumption fell by about 15%.

EXAMPLE 6

This Example illustrates the warp dyeing of blended yarns. This kind of dyeing could not yet be realized before.

A twisted warp yarn of 67% polyester and 33% cotton, yarn count (English) N 4, is dyed in an installation similar to the represented in FIG. 2.

The blended yarn is wound off from 15 warp beams having 700 threads each. All these yarns are uniformly combined, and the resulting row of substantially parallel yarns, having a width of about 160 cm and a homogeneous linear density of about 3, is introduced in a continuous manner into a dyeing bath containing, per liter:

"Cottestren Olive MW" (a dispersion-vat dyestuff mixture, of the BASF, Ludwigshafen Rhine, W. Germany): 100 g Acetic acid, 80 %: 1 ml "Trilon B" (ethylene diamine tetraacetic acid tetrasodium salt): 1 ml "Uniperol EL"(a wetting agent; ethoxylated animal fats, of the BASF, Ludwigshafen): 3 m.

After squeezing the excess dyeing liquor from the yarn row, the yarns are dried on a drying cylinder, separated into three equal fractions, and wound up on three loom beams having a width of 160 cm each. The warp yarn is woven together with raw white cotton weft yarn into a fabric which is then heated treated (thermosol process) during about 60 seconds at 200° C., in order to fix the dispersion dyestuff, and then treated in a conventional manner by the pad steam process in order to develop the vat dyestuff.

The dyed fabric is very level. The process of this Example allows the dyeing on a slightly modified slasher machine and does not require expensive piece dyeing machines which, in addition, have low production rates.

What is claimed is:

1. A continuous process for the treatment of warp yarns, wherein a row of substantially parallel, unbundled warp yarns is impregnated with an excess of a treating liquor, said excess is then removed from the impregnated yarns in a liquor removal zone, the yarns are dried and finally wound up on a loom beam, the process which comprises, at least in said liquor removal zone, the linear thread density of the warp yarn row, expressed by the relation $Q = F \times D$ wherein Q is the linear thread density, F is the thread count in $cm^{-1}$, and D is the mean diameter of each thread in cm, is brought to a value of at least 2, said value of at least 2 defining at least two complete superimposed sheets of warp yarns, with adjacent warp yarns contacting one another and being constant over the entire width of said yarn row and being substantially the same at any width increment, and the finally dried warp yarns are wound up on at least one loom beam, said increased linear thread density of at least 2 being reduced to the nominal thread count for weaving of each loom beam before the treated warp yarns are wound up on said beam.

2. The process of claim 1, wherein said excess of treating liquor is removed by at least one pair of squeezing rollers, the linear thread density Q in the nip between two cooperating rollers being at least 2.

3. The process of claim 1, wherein the linear thread density Q is selected from integers in the range of from 2 to 20 inclusive.

4. The process of claim 1, wherein Q values are selected which are whole numbers in the range of from 2 to 20 inclusive, and the treated yarn is wound up on more than one loom beam, the number of said loom beams being equal to Q.

5. The process of claim 1, wherein the working width of the treating machine used, but at least the working width of said liquor removal zone, is lower by the factor of 1/Q than the thread count on the loom beam.

6. The process of claim 1, wherein the desired value of Q is obtained by simultaneously introducing auxiliary yarns or fabrics into said liquor removal zone, together with said impregnated warp yarn.

7. The process of claim 1 wherein said treatment is selected from at least one treatment consisting of bleaching dyeing and sizing.

8. The process of claim 1, wherein said cotton warp yarn is first dyed and then sized before it is wound on the loom beam.

9. Cotton warp yarn, dyed by the process of claim 1, for the manufacture of blue denim apparel.

10. Cotton warp yarn, dyed and then sized by the process of claim 1, for the manufacture of blue denim apparel.

* * * * *